US005353754A

United States Patent [19]

Wissmann et al.

[11] Patent Number: 5,353,754

[45] Date of Patent: Oct. 11, 1994

[54] FUEL-INJECTION ARRANGEMENT FOR AN INTERNAL COMBUSTION ENGINE

[75] Inventors: Michael Wissmann, Mettmann; Hans Nickel, Cottenweiler; Roland Schierling, Affalterbach; Roland Adam, Besigheim; Manfred Thaiss, Winnenden; Werner Geyer, Waiblingen, all of Fed. Rep. of Germany

[73] Assignee: Andreas Stihl, Waiblingen, Fed. Rep. of Germany

[21] Appl. No.: 93,155

[22] Filed: Jul. 19, 1993

[30] Foreign Application Priority Data

Jul. 18, 1992 [DE] Fed. Rep. of Germany ..... 4223757

[51] Int. Cl.[5] ..... F02B 33/04

[52] U.S. Cl. ..... 123/73 C; 123/DIG. 5

[58] Field of Search ..... 123/73 C, 73 AD, DIG. 5; 417/380, 395

[56] References Cited

U.S. PATENT DOCUMENTS 4,976,246 12/1990 Schierling et al. ..... 123/73 AD

*Primary Examiner*—Noah P. Kamen

*Attorney, Agent, or Firm*—Walter Ottesen

[57] ABSTRACT

The invention is directed to a fuel-injection arrangement for a two-stroke engine in a motor-driven chain saw. An injection pump is mounted in a base housing with the injection pump including a pump piston axially displaceable in a pump cylinder. The pump piston delimits a pump chamber. The pump chamber is connected via a suction valve to a fuel tank. The fuel drawn by suction is pumped by the pump piston via a pressure valve, an injection line and an injection valve to the engine. For driving the pump piston, the latter is connected at one end to a membrane via a membrane plate. The membrane delimits a work chamber charged with fluctuating crankcase pressure. A simple assembly is provided by arranging the pump chamber, the suction valve and the pressure valve in a common valve housing which, in turn, is seated in the base housing of the injection pump in a seal-tight manner. The injection line is connected directly to the valve housing. This permits a preassembly of the valve housing with the valves provided therein which facilitates the manufacture of the fuel-injection arrangement.

22 Claims, 6 Drawing Sheets

FUEL-INJECTION ARRANGEMENT FOR AN INTERNAL COMBUSTION ENGINE

FIELD OF THE INVENTION

The invention relates to a fuel-injection arrangement for an internal combustion engine and especially for a two-stroke engine in a portable handheld work apparatus such as a motor-driven chain saw or the like.

BACKGROUND OF THE INVENTION

U.S. Pat. No. 4,976,246 discloses a fuel-injection arrangement of this kind. A plurality of receiving bores are provided in the base housing which are connected width each other via appropriately arranged conducting bores. The pneumatic conducting bores and the fuel-feed bores, which are essentially without pressure, can be sealed with reasonable effort. However, the sealing of the high-pressure bores requires a considerable effort with respect to manufacturing. The pressure-tight connection of the pump chamber provided in the pump cylinder to the suction valve and the pressure valve are problematic since this sealing must especially guarantee the dynamic seal over a wide temperature range. For this reason, materials having the same temperature coefficient are used for the base housing and for the inserts which makes the production of the base housing as well as the inserts, which are machined for a seal-tight fit, and the receiving bores very complex. Furthermore, the excellent thermal conductivity of the metal leads to an intense warming of the injection pump since a considerable quantity of heat is supplied via the driving hot crankcase gases. This can therefore lead to operational disturbances in the injection pump because of the formation of vapor bubbles especially after work has been interrupted.

SUMMARY OF THE INVENTION

It is an object of the invention to provide a fuel-injection arrangement of the kind described above which is improved to ensure sealing which is stable with respect to temperature even at the high pressure end and which provides reduced complexity with respect to manufacture and sealing.

The fuel-injection arrangement of the invention is for an internal combustion engine such as a two-stroke engine of a portable handheld work apparatus such as a motor-driven chain saw and the like. The engine has a crankcase wherein a crankcase pressure is developed during operation of the engine. The fuel-injection arrangement includes: a fuel tank for supplying fuel for the engine; a suction line communicating with the fuel tank for conducting fuel away therefrom; a base housing; a valve housing seated in the base housing; an injection pump disposed in the base housing for pumping fuel to the engine and including a pump chamber formed in the valve housing; a suction valve disposed in the valve housing upstream of the pump chamber and connected to the suction line for passing fuel therefrom into the pump chamber; the injection pump further including: a pump cylinder; and, a pump piston delimiting the pump chamber and being axially displaceable in the cylinder for pumping the fuel entering the pump chamber; a pressure valve disposed in the valve housing downstream of the pump chamber for passing the fuel pumped by the injection pump; an injection line connected to the pressure valve for conducting the pumped fuel to the engine; the base housing having a space formed therein and the injection pump further including: a membrane mounted in the base housing and delimiting a work chamber in the space; and, means for connecting the membrane to the piston; conduit means for connecting the crankcase of the engine to the work chamber for charging the work chamber with the crankcase pressure thereby driving the membrane and the piston; interface sealing means for providing a seal-tight interface between the base housing and the valve housing; and, receptacle means formed on the valve housing for providing a seal-tight connection with the injection line.

The valve housing with the suction valve, the pump chamber and the pressure valve define a component unit which can be preassembled and which can be seated in a pressure-tight manner in a receiving bore of the base housing. In the base housing, only one receiving bore is needed whereby the complexity of manufacture is reduced. In addition, the arrangement of the valves and the pump chamber in a common valve housing permits a reduced complexity with respect to sealing since slight leakage flows between the suction valve and the pump chamber or the pressure valve and the pump chamber are limited to the hydraulic system within the valve housing and cannot escape to the outside. The valve housing itself is sealed in the base housing with the injection line being connected directly to the valve housing itself so that no high-pressure line need be provided within the base housing.

The configuration according to the invention permits the use of materials of different temperature coefficients for the base housing and the valve housing. In this way, the valve housing can be made of a metal which provides the necessary stiffness for the high-pressure end; whereas, the base housing itself can be made of a poorly heat-conducting material such as plastic. A plastic base housing of this kind is especially injection molded and is simple to manufacture and reduces the heat transfer to the valve housing. The slight heat quantity received by the valve housing can easily be conducted away via the through-flowing fuel volume so that even after long work interruptions, a formation of vapor bubbles in the injection pump is avoided. The fuel-injection arrangement of the invention has a high operational reliability.

Another embodiment of the invention ensures the sealing of the valve housing in the base housing in a simple manner. For this purpose, the valve housing is provided with a press fit in the receiving bore of the base housing. The press fit guarantees a dynamic sealing of the pump chamber. Preferably, outer sealing rings are arranged at both axial ends of the valve housing section defining the press fit to provide a static seal. These outer sealing rings are especially radially pretensioned O-rings.

The work chamber of the injection pump is delimited by a connecting cover fixed to the base housing. The connecting cover at the same time fixes the membrane, which delimits the work chamber, between the base housing and the connecting cover. This cover is especially made of metal, preferably from aluminum, magnesium or an alloy of these metals and, in this way, guarantees that the heat will be conducted away so that a major part of the heat quantity supplied via the hot crankcase gases is given up to the outside via the connecting cover. Only a fraction of the supplied quantity of heat flows via the poorly heat-conducting material of the base housing to the valve housing.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
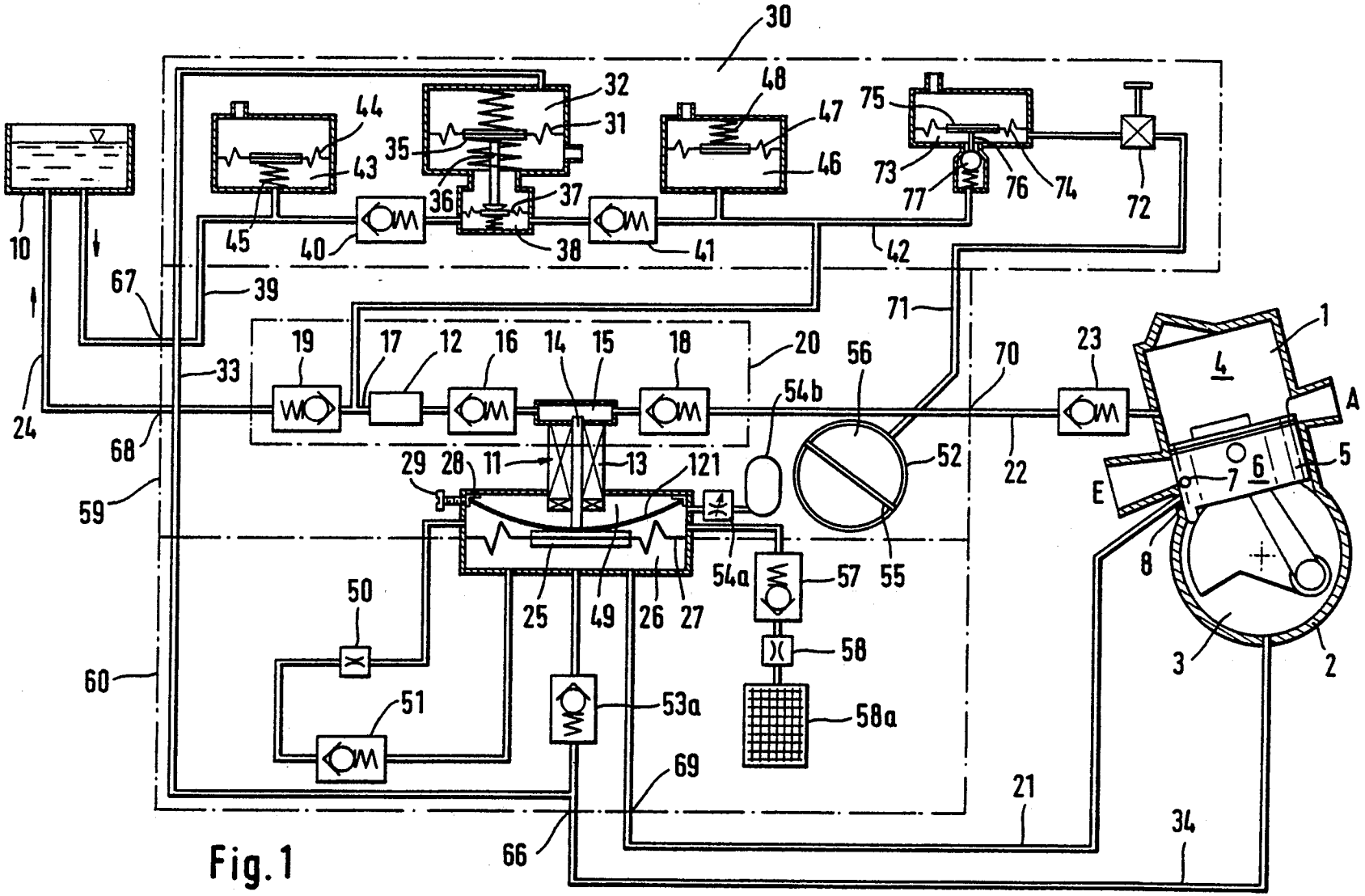
FIG. 1 is a schematic of a fuel-injection arrangement according to the invention.

The fuel-injection arrangement shown schematically in FIG. 1 is for an internal combustion engine especially for a two-stroke engine 1 in a portable handheld work apparatus such as a motor-driven chain saw, cutoff machine, brushcutter or the like. The fuel-injection arrangement comprises essentially three function groups, namely, a fuel pump 30, an injection pump 11 and a connecting cover 60 for supplying the necessary drive energy to the injection pump 11 and to the fuel pump 30.

The injection pump 11 is integrated into a base housing 59 on which the connecting cover 60 as well as the fuel pump 30, which is premanufactured as a component, are assembled. The base housing 59, the integrated injection pump 11, the built-on fuel pump 30 and the connection cover 60 conjointly define an injection-pump block 9 (FIG. 2) which is connected to a fuel tank 10 via plug-in connections 67 and 68 on the one hand and is connected to the two-stroke engine 1 on the other hand via the plug-in connections 66 and 69 and the connecting receptacle 70.

The fuel pump 30 is driven via the connecting cover 60 by the crankcase pressure of the two-stroke engine 1. For this purpose, a work chamber 32 delimited by a membrane 31 is provided. The work chamber 32 is connected to the inner space 3 of the crankcase 2 via a pressure channel 33 and the connecting cover 60 as well as the plug-in connection 66 and an external connecting line 34. The pressure channel 33 is configured in the base housing 59. The membrane 31 controls a pump membrane 37 via a membrane plate 35 and a pin 36. The pump membrane 37 delimits the pump chamber 38. The pump chamber 38 is connected via a suction valve 40 to a fuel feed 39 which supplies fuel from the fuel tank 10. The fuel is supplied to a suction line 17 of the injection pump 11 via a pressure valve 41 and a pressure line 42. The suction line 17 is connected via a fuel filter 12 and a suction valve 16 to an injection-pump chamber 15. When the suction valve 16 is closed, the fuel flows back into the fuel tank 10 via a pressure-holding valve 19 and a fuel return 24. The fuel is under pressure and is pumped by the fuel pump 30. When the suction valve 16 is closed, the fuel-feed pump recirculates the fuel from the fuel tank 10.

A compensating chamber 43 is connected to the fuel feed 39 forward of the suction valve 40 viewed in flow direction in order to compensate for pressure fluctuations in the fuel feed 39. The compensating chamber 43 is delimited by a membrane 44. The side of the membrane 44 facing away from the compensating chamber is charged with atmospheric pressure. A spring 45 is arranged in the compensating chamber 43 and resiliently biases the membrane 44 in a direction for enlarging the compensating chamber 43. An adequate quantity of fuel is made available to the suction valve 40 independently of the location of the fuel tank 10. This quantity of fuel is preferably sufficient to cover several suction strokes.

In the same manner, a compensating chamber 46 is provided downstream of the pressure valve 41 viewed in flow direction. The compensating chamber 46 is connected to the pressure line 42. The membrane 47 delimits the compensating chamber 46 and is subjected to atmospheric pressure on one side thereof. The membrane 47 is resiliently biased by a spring 48 on this side of the membrane in a direction which tends to reduce the volume of the compensating chamber 46. An equalization of the pressure on the suction end as well as on the pressure end can be obtained with the arrangement of the compensating chambers 43 and 46 so that pumping fluctuations of the fuel pump driven by the crankcase pressure can be equalized.

The injection pump 11 includes a pump cylinder 13 which is held in the base housing 59. The pump piston 14 is axially displaceable in the pump cylinder 13. The pump piston plunges into a pump chamber 15. For a downward movement referred to the built-in position shown in the drawing, the fuel under prepressure in the suction line 17 is pumped via the fuel filter 12 and the suction valve 16 into the pump chamber 15. For the upward stroke of the pump piston 14, the suction valve 16 closes and fuel is injected into the combustion chamber 4 of the two-stroke engine via the pressure valve 18 and an injection line 22 as well as the injection valve 23.

The pump piston 14 is actuated by a membrane plate 25 which holds a membrane 27 delimiting a work chamber 26. The work chamber 26 is formed essentially in the connecting cover 60 and communicates via a pulse line 21 and a bore 8 with the inner space 3 of the crankcase 2. The bore 8 is controlled by a control opening 7 in the piston skirt 6 of the piston 5 delimiting the combustion chamber 4 so that the pump piston 14 injects fuel via the pressure valve 18, the injection line 22 and the injection valve 23 into the combustion chamber 4 in correspondence to the position of the piston 5.

The membrane plate 25 is resiliently biased by a leaf spring 121 on the side of the membrane 27 facing away from the work chamber 26. The leaf spring 121 determines the rest position of the pump piston 14. The ends of the leaf spring 121 lie in bearings 28 which are supported in the housing 59 of the injection-pump block 9. One of the bearings 28 is adjustable with respect to its position via an adjusting screw 29 whereby the pretension of the leaf spring 121 can be changed.

The internal combustion engine 1 draws combustion air into the inner space 3 of the crankcase 2 via an intake channel E. This combustion air is necessary for the combustion and flows from the crankcase into the combustion chamber via piston-controlled overflow channels (not shown). The exhaust gases produced by the combustion are conducted away from the combustion chamber 4 via the exhaust channel A.

An intake channel section 52 is configured in the base housing 59 of the injection-pump block 9 and the combustion air is supplied to the two-stroke engine 1 via this intake channel section. In the embodiment shown, the suction channel section 52 is configured as a channel running along a straight line and extends from the one end face 53 (FIG. 2) of the injection-pump block 9 to the other end face 54 (FIG. 2) thereof. A throttle flap 56 is pivotally journalled in this channel section 52 on a pivot pin 55. The quantity of the combustion air flowing to the engine can be adjusted by this throttle flap 56. The throttle flap 56 can be actuated by a throttle lever journalled in the housing of the work apparatus via a linkage (not shown).

The work chamber 26 of the injection pump 11 is interconnected via the connecting cover 60 in such a manner that an adaptation is obtained of the volume pumped by the injection pump to the particular operating condition of the two-stroke engine 1. For this purpose, the rear chamber 49 of the injection pump, which contains the leaf spring 121, is connected to the work chamber 26 via a throttle 50 and a check valve 51 in such a manner that an overpressure in the rear chamber 49 can decay into the work chamber 26 via the throttle valve 50 and the check valve 51. In addition, the work chamber 26 is connected to the crankcase 2 via a check valve 53*a* which reduces pressure to the inner space 3 of the crankcase 2 in flow direction. The rear chamber 49 is also connected via an adjustable throttle 54*a* to a compensating volume 54*b*. A check valve 57 is provided for the pressure equalization in the rear chamber 49 with this pressure equalization being necessary when changes of load occur. The check valve 57 opens in the direction toward the rear chamber 49 and this valve is connected to the ambient via a throttle 58 and an input filter 58*a*.

As shown in FIG. 1, a bypass line 71 is formed in the fuel pump 30 as well as in the base housing 59. The bypass line bypasses the fuel pump 11 and leads to the intake channel section 52. The bypass line 71 branches off from the pressure line 42. A switchable valve 72 is arranged in the bypass line 71 and the bypass line 71 conducting the fuel is blocked or opened by means of this valve 72. A control chamber 73 is arranged forward of the valve 72 viewed in flow direction of the fuel. The control chamber 73 is delimited by a control membrane 74. The dry side of the control membrane is preferably charged with atmospheric pressure. The membrane plate 75 holds the control membrane 74 and includes an actuating pin 76 which controls a feed valve 77. The feed valve 77 always opens when the membrane plate 75 drops with the control membrane 74 into the control chamber 73 because of an underpressure which has developed.

Figure 2:
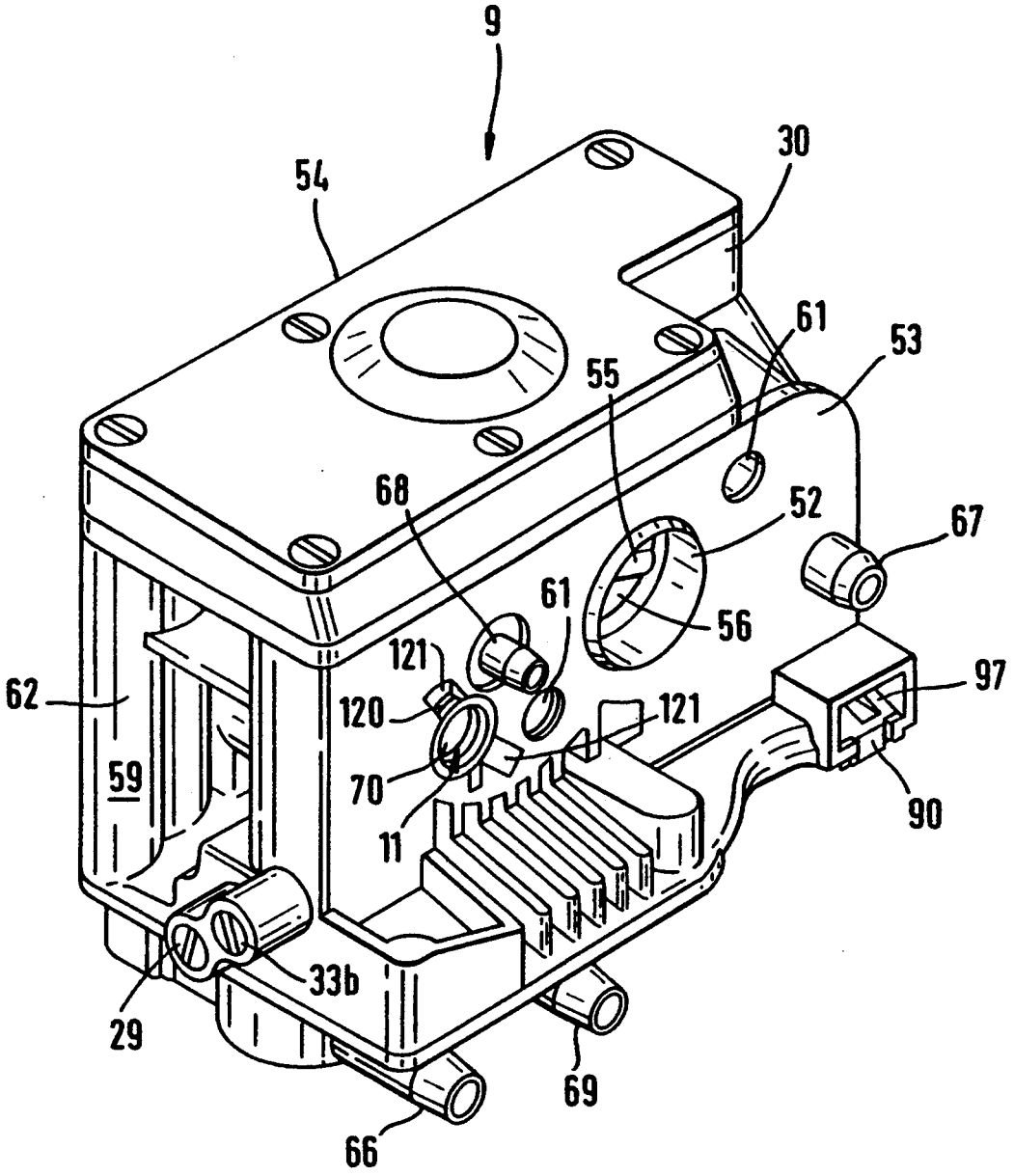
FIG. 2 is a perspective view of a fuel-injection arrangement configured as an injection-pump block.
Figure 5:
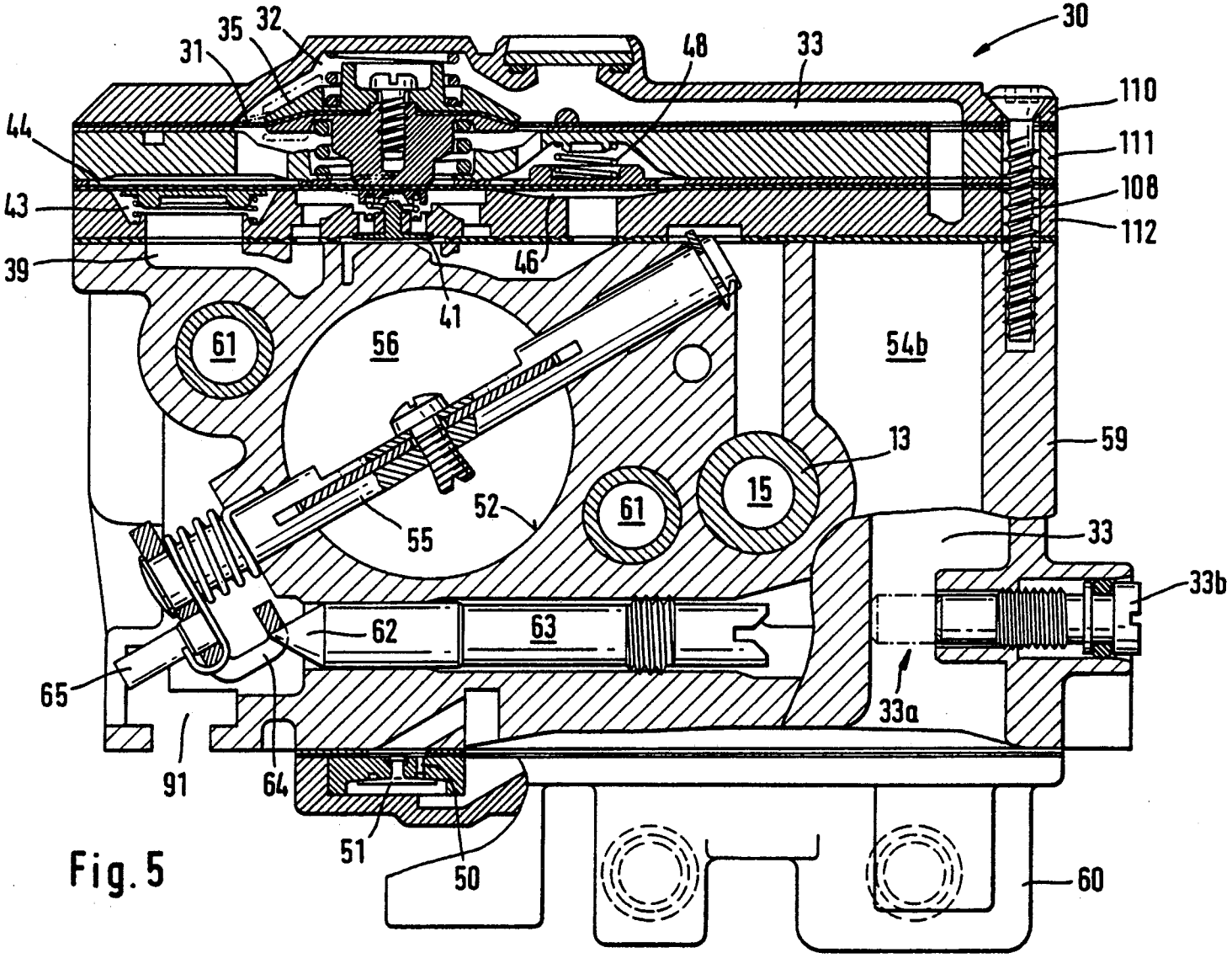
FIG. 5 is a longitudinal section view taken through the injection-pump block of FIG. 2; and, FIG. 6 is an enlarged view of the valve housing axially pressed into the base housing of the injection-pump block.

As shown in FIG. 2, the base housing 59 of the injection-pump block 9 has an essentially rectangular shape. The housing 59 is made of plastic in order to ensure a poor thermal conductivity. The plug-in connections 67 and 68 for the fuel tank and the connecting receptacle 70 for the injection line 22 are provided on the one side face 53 of the base housing. Furthermore, bores 61 extend from the one side face 53 to the other side face 54 and run parallel to the intake channel section 52. These bores accommodate bolts for mounting the injection-pump block 9. The necessary adjusting screws are held in the housing 59 and the heads of these adjusting screws are accessible from the narrow end face 62 of the base housing 59. The adjusting screw 33*b* shown in FIGS. 2 and 5 is provided for adjusting the throttle 54*a*. The adjusting screw 29 lies adjacent the adjusting screw 33*b* in the base housing 59 and is provided for adjusting the spring force acting on the pump piston 14. Both adjusting screws (29, 33*b*) are provided for adapting the pumped fuel quantity to the requirement of the engine. The head of an adjusting screw 63 lies in a recess of the narrow end face 62. The adjusting cone 63*a* of the adjusting screw 63 coacts with an adjusting arm 64 connected to the throttle flap pivot pin 55 so as to rotate therewith. The idle position of the throttle flap 56 can be adjusted via the adjusting screw 63.

Figure 3:
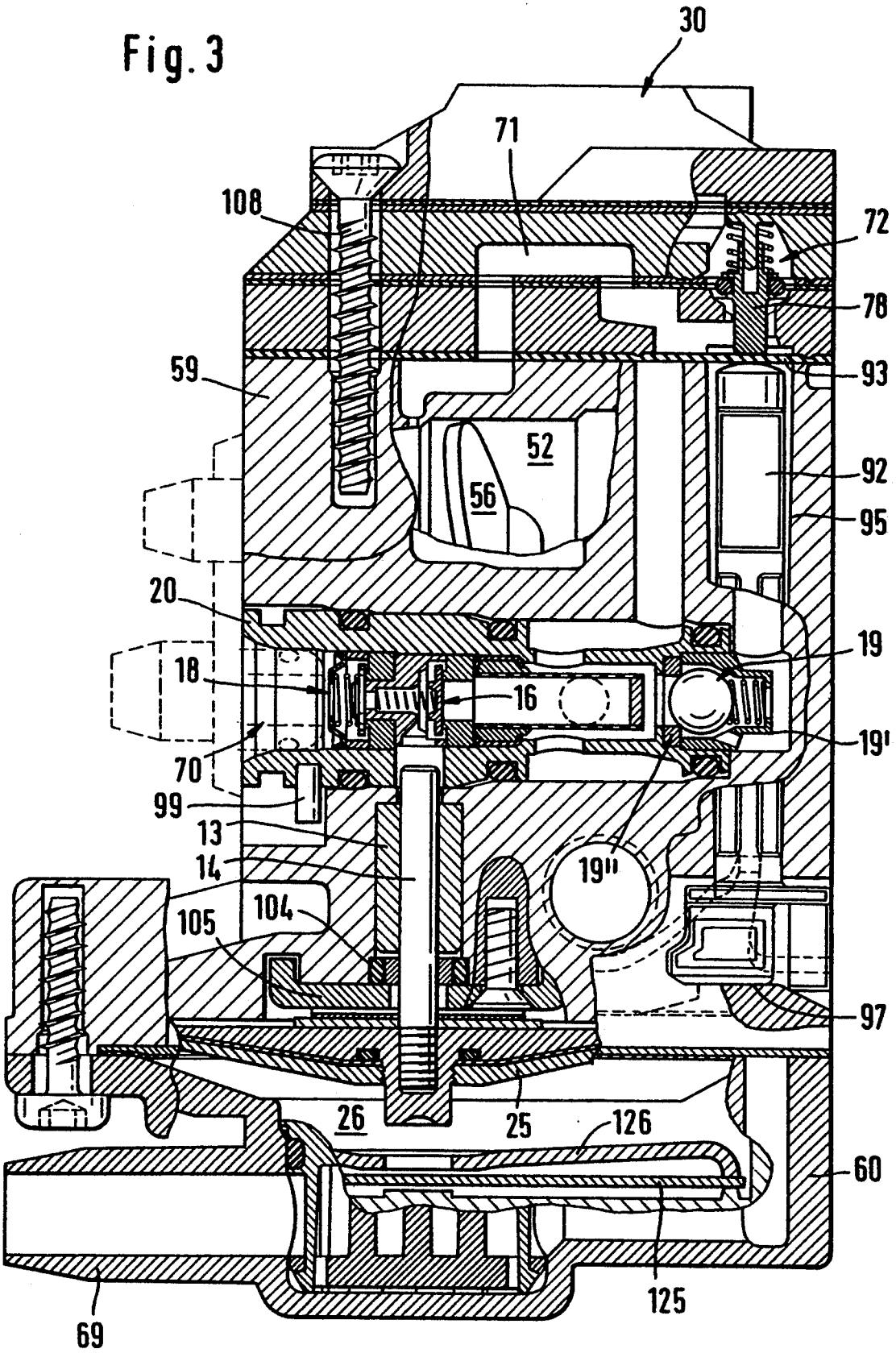
FIG. 3 is a section view taken through the injection-pump block at the location of the valve housing pressed into the base body.
Figure 4:
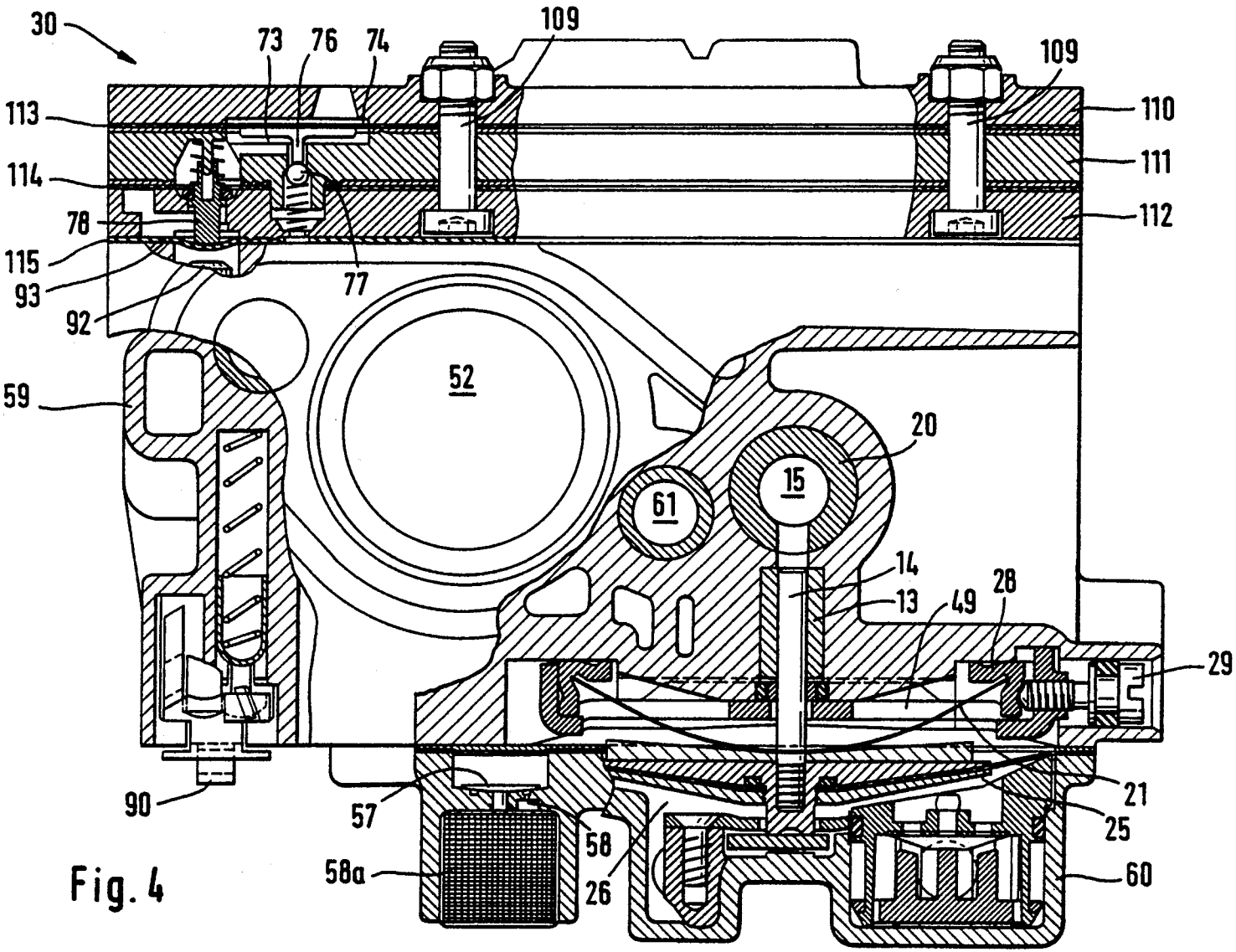
FIG. 4 is a side elevation view of the injection-pump block with partial views, in section, being taken through the base housing, connecting cover and fuel pump.

The adjusting arm 64 further has an adjusting bolt 65 extending therefrom. This adjusting bolt 65 projects into the positioning path of a manually-actuated slider 90 which is guided in a guide slot 91 of the base housing 59. The slider 90 on the one hand cooperates with the adjusting bolt 65 and, on the other hand, coacts with the actuating pin 92 which extends from the fuel pump 30 perpendicularly to the guide slot 91. As shown in FIG. 4, the actuating pin 92 acts via a sealing membrane 93 on a valve member 78 of the valve 72 in order to open this valve by lifting the valve member 78 from its valve seat. The actuating pin 92 is guided in a bore 95 of the base housing 59 as shown in FIG. 3. The actuating pin 92 has an end facing away from the valve 72 and this end is in contact engagement with a switching ramp 97 of the slider 90. The switching ramp 97 rises or drops in the longitudinal direction of the slider 90. If the slider 90 is displaced in the guide slot 91 in a direction transverse to the longitudinal center axis of the actuating pin 92, then the end of the actuating pin 92 moves up on the ramp 97 and is lifted whereby its other end moves on the dry side of the sealing membrane 93 against the valve member 78 and lifts the valve member 78 whereby the valve 72 is opened. The engine can be started when there is a disturbance of the injection pump, for example, because of air drawn in by suction. Preferably, the throttle flap is held in its idle position in a first position thereof whereby a start with a rich mixture is possible. In a second position, the throttle flap 56 is opened further via the slider 90 and the adjusting arm 65 in order to move into a start gas or hot start position.

Figure 6:
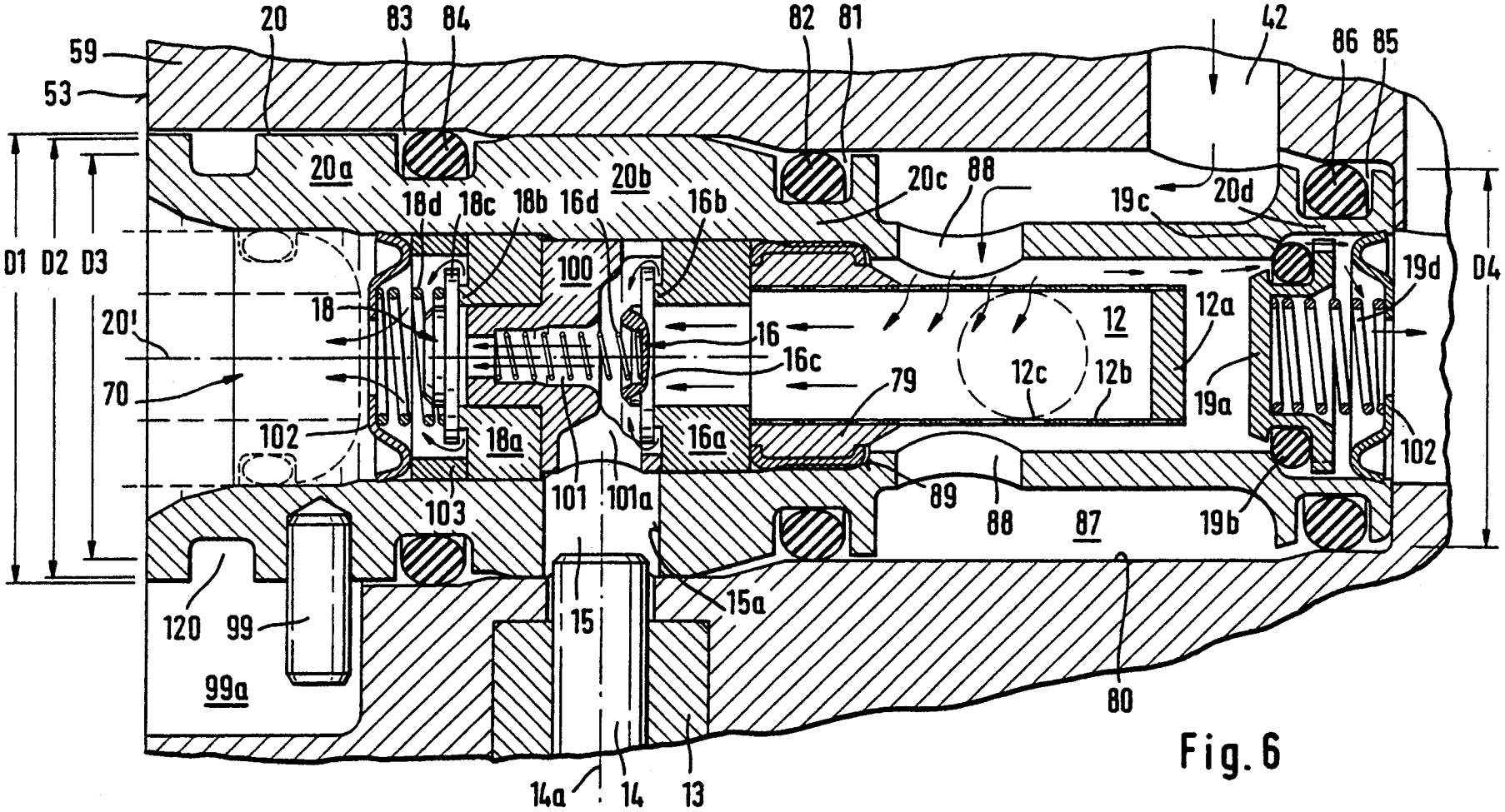

The slider 90 and how it coacts with the actuating pin 92 and adjusting arm 65 is shown in greater detail in FIGS. 5 and 6 of patent application Ser. No. 08/093,160 and which is incorporated herein by reference and which claims priority from German patent application P 42 23 758.0 filed on Jul. 18, 1992.

A valve housing 20 is integrated into the base housing 59. The valve housing is seated axially into a receiving bore of the base housing. This receiving bore is perpendicular to the longitudinal side 53 of the base housing 59 and extends from this side. The valve housing is a cylinder essentially configured as having multiple steps and is shown enlarged in FIG. 6. A locking pin 99 extends radially into the cylinder to hold the cylinder so that it does not rotate in the base housing 59. The locking pin 99 engages in an axial slot 99*a* in the wall of the receiving bore 80. The pump chamber 15 with the suction valve 16 and the pressure valve 18 as well as the fuel filter 12 and the pressure-holding valve 19 are arranged in the valve housing 20. The connecting receptacle 70 is configured on the end of the valve housing 20 lying on the side 53 thereof for connecting the injection line 22.

The valve housing is made of metal and is configured to have several stages of reduced diameter along its length starting from its end forming the connecting receptacle 70. The connecting receptacle 70 is configured in the first stage 20*a* having the largest diameter D1. The locking pin 99 is also provided in this first stage. The end of the cylinder stage 20*a* facing toward the side face 53 advantageously includes an external peripheral slot 120 which is accessible via recesses 121 (FIG. 2) provided in the longitudinal end face 53 of the housing 59. The recesses 121 lie approximately diametrically opposite each other and permit access of a tool for pulling out the cylinder 20 or permit the engagement of latching means of the high-pressure connection of the injection line 22 which can engage into the peripheral slot 120. A stage 20*b* extends from stage 20*a* and has a smaller diameter D2. The stage 20*b* is seated in the receiving bore 80 with a press fit. The stage 20*c* extends from the stage 20*b* and has a diameter D3 which is further reduced. The stage 20*c* has a peripheral slot 81 in which a sealing ring 82 lies. In the same manner, a peripheral slot 83 is provided in the stage 20*a* having the larger diameter D1 and a sealing ring 84 is arranged in this peripheral slot 83.

The valve housing 20 terminates with a stage 20*d* of smallest diameter D4 wherein a peripheral slot 85 is likewise provided and in which a sealing ring 86 is mounted. The sealing rings 82 and 84 are preferable radially braced O-rings which provide for the static sealing of the valve housing. The radial press fit between the stage 20*b* of the valve housing 20 and the base housing 59 provides for a dynamic sealing of the valve housing.

A wide peripheral slot 87 is provided between the stage 20*d* of smallest diameter D4 and the stage 20*c*. Radial feed openings 88 for the fuel are provided in the base of the peripheral slot 87. The fuel flows to the fuel pump via the pressure line 42. The pressure line 42 is formed from the fuel pump 30 to the peripheral slot 87 in the base housing 59 of the injection-pump block 9.

The cylindrical inner space of the valve housing 20 is slightly stepped several times in order to receive the elements forming the valve in a pressure-tight manner. A shoulder 89 facing toward the connecting receptacle 70 is formed in the stage 20*c* next to the feed openings 88. The attachment end 79 of a fuel filter 12 is in contact engagement with the shoulder 89. The fuel filter 12 is configured as a perforated cylinder. The end of the fuel filter facing away from the attachment end 79 is closed by means of a plug 12*a*. A plurality of filter openings 12*c* are provided in the cylinder 12*b*. Fuel can enter the cylinder 12*b* through these openings 12*c* in order to flow away in the direction of the connecting receptacle 70.

A valve seat ring 16*a* lies at the attachment end 79 and is held seal-tight in the stage 20*b* of the valve housing 20. The valve seat edge 16*b* faces toward the connecting receptacle 70. A valve plate 16*c* lies as a valve body on the valve seat edge 16*b*. The valve plate 16*c* is resiliently biased into its closed position by a spring 16*d*. The suction valve 16 of the injection pump 11 is conjointly defined by the valve seat ring 16*a* with its valve seat 16*b*, the valve plate 16*c* and the spring 16*d*.

The spring 16*d* is held in a support part 100 which is braced on the one hand on valve seat ring 16*a* and, on the other hand, on the valve seat ring 18*a* which likewise is arranged in the stage 20*b* of the valve housing 20. The support part 100 has a central through bore 101 which is expanded on the end facing toward the suction valve 16 so that the support part 100 surrounds the valve plate 16*c* in a manner of a hood with such a play that a disturbance-free opening and closing of the suction valve 16 is ensured.

The support part 100 projects into the valve seat ring 18*a* of the pressure valve 18 on the end of the support part 100 facing away from the suction valve 16. A valve plate 18*c* lies on a valve seat ring 18*b* facing toward the receptacle connection 70 in the same manner as for suction valve 16. The valve plate 18*c* is resiliently biased into its closed position by a spring 18*d*. The spring 18*d* is braced on the support ring 102 clamped tightly in the valve housing 20. At the same time, the support ring 102 axially secures the valve seat 18*a* via a spacer ring 103 so that the entire arrangement comprising the attachment end 79, valve seat ring 16*a*, support part 100, valve seat ring 18*a* and spacer ring 103 are held against the shoulder 89 so that they cannot be axially displaced. The support part 100 is furthermore so configured that the pump chamber 15 is as small as possible so that air bubbles or vapor bubbles present in the pump chamber can easily be transported away with the fuel flow.

The through bore 101 has a transverse bore 101*a* in the region of its hood-like expansion. The transverse bore 101*a* communicates with a radial bore 15*a* in the valve housing 20. The radial bore 15*a* forms the section of the pump chamber 15 into which the pump piston 14 plunges. The radial press fit of the stage 20*b* ensures the dynamic sealing of the pump chamber 15 with respect to the base housing 59; whereas, the sealing rings 82 and 84 ensure the static sealing. The sealing rings 82 and 84 are formed as radially-braced O-rings.

The longitudinal center axis 14*a* of the pump piston 14 lies at right angles to the longitudinal center axis 20' of the valve housing 20. The pump piston 14 is guided so as to be axially displaceable in the pump cylinder 13 and seal-tight with respect to the fluid under pressure. The pump cylinder 13 is press fitted into the base housing 59 and ensures the necessary dynamic sealing of the pump chamber relative to the drive chamber of the pump piston because of the axial length provided therefor. As shown in FIG. 3, a static seal in the form of a sealing ring 104 is arranged at the end of the pump cylinder 13 facing away from the pump chamber. A holding disc 105 is attached to the base housing and prevents an axial displacement of the static seal 104. The pump piston 14 projects through the holding disc 105.

The end of the valve housing 20 next to the plug 12*a* of the fuel filter tube 12*b* is closed by means of the pressure-holding valve 19. The pressure-holding valve 19 is configured from a valve member 19*a* provided with a sealing ring 19*b*. The valve mender 19*a* lies against the seat ring 19*c* formed in the valve housing 20 with a pregiven force via a spring 19*d*. The spring 19*d* is held by a support ring 102 clamped tightly in the expanded end of the valve housing 20.

The pressure-holding valve 19 can be configured as a ball valve as shown in FIG. 3. A sealing ring 19'' is seated in the expanded end of the valve housing 20 and a spring is held thereon by means of a valve ball. The valve ball and the valve spring are mounted in an insert housing 19' which is seated in the free end of the valve housing 20 so that it does not separate therefrom in the axial direction.

As shown in FIGS. 3 and 4, the pneumatic connections of the lines 21 and 24 are provided via plug-in connections 66 and 69 formed on the connecting cover 60. The connecting cover 60 is made of metal in order to provide an improved drain-off of heat of the hot crankcase gases which enter. The heat conductivity to the injection pump 11 mounted in the base housing is limited because the base housing 59 is made of plastic.

Increased heat which could affect the operability of the injection pump can be avoided in this way. A cooling of the injection pump is also obtained by recirculating the fuel via the pressure-holding valve 19.

As shown in FIGS. 3, 4 and 5, the throttle 50 and the check valve 51 for the pressure-equalizing connection between the return chamber 49 and the work chamber 26 are arranged in the connecting cover 60. The check valve 53*a* and the check valve 57, the throttle 58 and the input filter 58*a* are also arranged in the connecting cover 60. Furthermore, an actuating member 125 is arranged in the connecting cover 60 and lies opposite the membrane plate 25. The actuating member 125 is preferably a bimetal strip which is held by a frame 126. The displacement of the bimetal strip 125 causes an axial change of the rest position of the membrane plate and therefore of the pump piston 14 so that, for a cold engine, a larger pump piston stroke is permitted than for a warm engine. This permits the adaptation of the start quantity especially for cold-start operation.

The fuel pump comprises plates 110, 111 and 112, with these plates being joined to each other by means of screws 109 to form a packet. Appropriate hollow spaces are formed in the plates for receiving the following: the valves, the movable parts of the fuel pump, the work chamber 32, the pump chamber 38, the equalization chambers 43 and 46, the flow valve 72 and the control chamber 73 with the feed valve 77. When the plates are assembled, the various chambers are closed by respective adjacent plates with the necessary line connections being provided by appropriate recesses and by bores in the plates.

The work chamber 32 is supplied with the hot crankcase gases as the drive energy. The work chamber 32 is delimited by the external plate 110 made of metal in order to provide a good thermal drain.

Sealing foils 113, 114 and 115 are arranged between the plates and provide, on the one hand, the necessary sealing of the various chambers and conducting lines. On the other hand, the sealing foils pass transversely through the corresponding chambers as membrane-forming elements.

The fuel pump is prebuilt from the assembled plates by means of the screws 109. The fuel pump is attached as a preassembled component to the base housing 59 by means of screws 108 (FIG. 3). The sealing foil 115 is disposed between the fuel pump 30 and the base housing 59. The sealing foil 115 contains pass-through openings through which the necessary connections are provided between the fuel pump and the base housing. To obtain an increased sealing action, sealing ribs can be advantageously formed on the plates.

It is understood that the foregoing description is that of the preferred embodiments of the invention and that various changes and modifications may be made thereto without departing from the spirit and scope of the invention as defined in the appended claims.

What is claimed is:

1. A fuel-injection arrangement for an internal combustion engine such as a two-stroke engine of a portable handheld work apparatus such as a motor-driven chain saw and the like, the engine having a crankcase wherein a crankcase pressure is developed during operation of the engine, the fuel-injection arrangement comprising:

a fuel tank for supplying fuel for the engine;

a suction line communicating with said fuel tank for conducting fuel away therefrom;

a base housing;

an ancillary housing;

an injection pump disposed in said base housing for pumping fuel to the engine and including a pump chamber formed in said ancillary housing;

a suction valve disposed in said ancillary housing upstream of said pump chamber and connected to said suction line for passing fuel therefrom into said pump chamber;

said injection pump further including: a pump cylinder; and, a pump piston delimiting said pump chamber and being axially displaceable in said cylinder for pumping the fuel entering said pump chamber;

a pressure valve disposed in said ancillary housing downstream of said pump chamber for passing the fuel pumped by said injection pump;

said ancillary housing incorporating said pump chamber, said suction valve and said pressure valve to define a preassembled unit;

said base housing having a seat formed therein for receiving and accommodating said preassembled unit in said base housing;

an injection line connected to said pressure valve for conducting the pumped fuel to the engine;

said base housing having a space formed therein and said injection pump further including: a membrane mounted in said base housing and delimiting a work chamber in said space; and, means for connecting said membrane to said piston;

conduit means for connecting the crankcase of said engine to said work chamber for charging said work chamber with said crankcase pressure thereby driving said membrane and said piston;

interface sealing means for providing a seal-tight interface between said base housing and said ancillary housing;

receptacle means formed on said ancillary housing for providing a seal-tight connection with said injection line; and, said connecting means including a membrane plate holding said membrane and said membrane plate being connected to said piston.

2. The fuel-injection arrangement of claim 1, further comprising a fuel pump having a pressure connection and said suction line being connected to said pressure connection; and, said fuel pump being configured as a component part attached to said base housing.

3. A fuel-injection arrangement for an internal combustion engine such as a two-stroke engine of a portable handheld work apparatus such as a motor-driven chain saw and the like, the engine having a crankcase wherein a crankcase pressure is developed during operation of the engine, the fuel-injection arrangement comprising:

a fuel tank for supplying fuel for the engine;

a suction line communicating with said fuel tank for conducting fuel away therefrom;

a base housing;

a valve housing seated in said base housing;

an injection pump disposed in said base housing for pumping fuel to the engine and including a pump chamber formed in said valve housing;

a suction valve disposed in said valve housing upstream of said pump chamber and connected to said suction line for passing fuel therefrom into said pump chamber;

said injection pump further including: a pump cylinder; and, a pump piston delimiting said pump chamber and being axially displaceable in said cylinder for pumping the fuel entering said pump chamber;

a pressure valve disposed in said valve housing downstream of said pump chamber for passing the fuel pumped by said injection pump;

an injection line connected to said pressure valve for conducting the pumped fuel to the engine;

said base housing having a space formed therein and said injection pump further including: a membrane mounted in said base housing and delimiting a work chamber in said space; and, means for connecting said membrane to said piston;

conduit means for connecting the crankcase of said engine to said work chamber for charging said work chamber with said crankcase pressure thereby driving said membrane and said piston;

interface sealing means for providing a seal-tight interface between said base housing and said valve housing;

receptacle means formed on said valve housing for providing a seal-tight connection with said injection line; and, said valve housing being made of a good heat conducting material and said base housing being made of a poor heat conducting material.

4. The fuel-injection arrangement of claim 3, said valve housing being made of metal and said base housing being made of plastic.

5. A fuel-injection arrangement for an internal combustion engine such as a two-stroke engine of a portable handheld work apparatus such as a motor-driven chain saw and the like, the engine having a crankcase wherein a crankcase pressure is developed during operation of the engine, the fuel-injection arrangement comprising:

a fuel tank for supplying fuel for the engine;

a suction line communicating with said fuel tank for conducting fuel away therefrom;

a base housing;

a valve housing seated in said base housing;

an injection pump disposed in said base housing for pumping fuel to the engine and including a pump chamber formed in said valve housing;

a suction valve disposed in said valve housing upstream of said pump chamber and connected to said suction line for passing fuel therefrom into said pump chamber;

said injection pump further including: a pump cylinder; and, a pump piston delimiting said pump chamber and being axially displaceable in said cylinder for pumping the fuel entering said pump chamber;

a pressure valve disposed in said valve housing downstream of said pump chamber for passing the fuel pumped by said injection pump;

an injection line connected to said pressure valve for conducting the pumped fuel to the engine;

said base housing having a space formed therein and said injection pump further including: a membrane mounted in said base housing and delimiting a work chamber in said space; and, means for connecting said membrane to said piston;

conduit means for connecting the crankcase of said engine to said work chamber for charging said work chamber with said crankcase pressure thereby driving said membrane and said piston;

interface sealing means for providing a seal-tight interface between said base housing and said valve housing;

receptacle means formed on said valve housing for providing a seal-tight connection with said injection line;

said base housing having a receiving bore formed therein and said valve housing being disposed in said receiving bore; and, said interface sealing means including an interference fit between said base housing and said valve housing for holding said valve housing in said receiving bore of said base housing.

6. The fuel-injection arrangement of claim 5, said valve housing having a longitudinal axis and including a plurality of stages one behind the other and said interface sealing means being arranged on one of said stages and further including two sealing rings disposed on respective longitudinal ends of said one stage so as to be between said receiving bore and said valve housing.

7. The fuel-injection arrangement of claim 6, said sealing rings being radially-tensioned O-rings.

8. The fuel-injection arrangement of claim 6, said valve housing having a cylindrical outer surface and each two mutually adjacent ones of said stages having different outer diameters causing said outer surface to be a stepped surface.

9. The fuel-injection arrangement of claim 8, further comprising fixing means for fixing said valve housing to prevent rotation thereof in said receiving bore.

10. The fuel-injection arrangement of claim 8, said suction valve, said pump chamber and said pressure valve being arranged along said axis one behind the other.

11. The fuel-injection arrangement of claim 10, said pump chamber having an opening formed in said valve housing for permitting said pump piston to plunge into said pump chamber.

12. The fuel-injection arrangement of claim 11, said pump piston having a longitudinal piston axis extending perpendicularly to said longitudinal axis of said valve housing.

13. A fuel-injection arrangement for an internal combustion engine such as a two-stroke engine of a portable handheld work apparatus such as a motor-driven chain saw and the like, the engine having a crankcase wherein a crankcase pressure is developed during operation of the engine, the fuel-injection arrangement comprising:

a fuel tank for supplying fuel for the engine;

a suction line communicating with said fuel tank for conducting fuel away therefrom;

a base housing;

a valve housing seated in said base housing;

an injection pump disposed in said base housing for pumping fuel to the engine and including a pump chamber formed in said valve housing;

a suction valve disposed in said valve housing upstream of said pump chamber and connected to said suction line for passing fuel therefrom into said pump chamber;

said injection pump further including: a pump cylinder; and, a pump piston delimiting said pump chamber and being axially displaceable in said cylinder for pumping the fuel entering said pump chamber;

a pressure valve disposed in said valve housing downstream of said pump chamber for passing the fuel pumped by said injection pump;

an injection line connected to said pressure valve for conducting the pumped fuel to the engine;

said base housing having a space formed therein and said injection pump further including: a membrane mounted in said base housing and delimiting a work chamber in said space; and, means for connecting said membrane to said piston;

conduit means for connecting the crankcase of said engine to said work chamber for charging said work chamber with said crankcase pressure thereby driving said membrane and said piston;

interface sealing means for providing a seal-tight interface between said base housing and said valve housing;

receptacle means formed on said valve housing for providing a seal-tight connection with said injection line; and, a fuel filter held in said valve housing upstream of said suction valve.

14. The fuel-injection arrangement of claim 13, said valve housing having a housing wall defining a longitudinal axis; and, said fuel filter being a perforated filter disposed coaxially within said housing wall.

15. The fuel-injection arrangement of claim 13, said valve housing having a housing wall defining a longitudinal axis; said valve housing having a longitudinal end facing toward said suction valve; and, said arrangement further comprising closure means arranged at said longitudinal end for closing said longitudinal end of said valve housing; and, said valve housing having radial inlet openings formed therein between said suction valve and said closure means.

16. The fuel-injection arrangement of claim 15, said closure means being a pressure-holding valve.

17. The fuel-injection arrangement of claim 16, said pressure-holding valve being a ball valve.

18. A fuel-injection arrangement for an internal combustion engine such as a two-stroke engine of a portable handheld work apparatus such as a motor-driven chain saw and the like, the engine having a crankcase wherein a crankcase pressure is developed during operation of the engine, the fuel-injection arrangement comprising:

a fuel tank for supplying fuel for the engine;

a suction line communicating with said fuel tank for conducting fuel away therefrom;

a base housing;

a valve housing seated in said base housing;

an injection pump disposed in said base housing for pumping fuel to the engine and including a pump chamber formed in said valve housing;

a suction valve disposed in said valve housing upstream of said pump chamber and connected to said suction line for passing fuel therefrom into said pump chamber;

said injection pump further including: a pump cylinder; and, a pump piston delimiting said pump chamber and being axially displaceable in said cylinder for pumping the fuel entering said pump chamber;

a pressure valve disposed in said valve housing downstream of said pump chamber for passing the fuel pumped by said injection pump;

an injection line connected to said pressure valve for conducting the pumped fuel to the engine;

said base housing having a space formed therein and said injection pump further including: a membrane mounted in said base housing and delimiting a work chamber in said space; and, means for connecting said membrane to said piston;

conduit means for connecting the crankcase of said engine to said work chamber for charging said work chamber with said crankcase pressure thereby driving said membrane and said piston;

interface sealing means for providing a seal-tight interface between said base housing and said valve housing;

receptacle means formed on said valve housing for providing a seal-tight connection with said injection line; and, said base housing having a receiving bore formed therein for receiving said valve housing;

said valve housing having a cylindrical housing wall defining a longitudinal axis;

said valve housing including a plurality of stages disposed one behind the other along said axis;

said cylindrical housing wall being subdivided into a plurality of wall sections corresponding to respective ones of said stages;

one of said stages including said pump chamber surrounded by the wall section corresponding to said one stage;

said receiving bore having a surface portion opposite said one wall section when said valve housing is seated in said receiving bore; and, said interface sealing means including an interference fit between said one wall section and said housing portion.

19. A fuel-injection arrangement for an internal combustion engine such as a two-stroke engine of a portable handheld work apparatus such as a motor-driven chain saw and the like, the engine having a crankcase wherein a crankcase pressure is developed during operation of the engine, the fuel-injection arrangement comprising:

a fuel tank for supplying fuel for the engine;

a suction line communicating with said fuel tank for conducting fuel away therefrom;

a base housing;

a valve housing seated in said base housing;

an injection pump disposed in said base housing for pumping fuel to the engine and including a pump chamber formed in said valve housing;

a suction valve disposed in said valve housing upstream of said pump chamber and connected to said suction line for passing fuel therefrom into said pump chamber;

said injection pump further including: a pump cylinder; and, a pump piston delimiting said pump chamber and being axially displaceable in said cylinder for pumping the fuel entering said pump chamber;

a pressure valve disposed in said valve housing downstream of said pump chamber for passing the fuel pumped by said injection pump;

an injection line connected to said pressure valve for conducting the pumped fuel to the engine;

said base housing having a space formed therein and said injection pump further including: a membrane mounted in said base housing and delimiting a work chamber in said space; and, means for connecting said membrane to said piston;

conduit means for connecting the crankcase of said engine to said work chamber for charging said work chamber with said crankcase pressure thereby driving said membrane and said piston;

interface sealing means for providing a seal-tight interface between said base housing and said valve housing;

receptacle means formed on said valve housing for providing a seal-tight connection with said injection line; and, a connecting cover attached to said base housing and coacting with said membrane to delimit said work chamber.

20. The fuel-injection arrangement of claim 19, said connecting cover being made of a metal.

21. The fuel-injection arrangement of claim 19, said connecting cover being made of a metal selected from the group consisting of aluminum, magnesium and an alloy of aluminum and magnesium.

22. A fuel-injection arrangement for an internal combustion engine such as a two-stroke engine of a portable handheld work apparatus such as a motor-driven chain saw and the like, the engine having a crankcase wherein a crankcase pressure is developed during operation of the engine, the fuel-injection arrangement comprising:

a fuel tank for supplying fuel for the engine;

a suction line communicating with said fuel tank for conducting fuel away therefrom;

a base housing;

a valve housing seated in said base housing;

an injection pump disposed in said base housing for pumping fuel to the engine and including a pump chamber formed in said valve housing;

a suction valve disposed in said valve housing upstream of said pump chamber and connected to said suction line for passing fuel therefrom into said pump chamber;

said injection pump further including: a pump cylinder; and, a pump piston delimiting said pump chamber and being axially displaceable in said cylinder for pumping the fuel entering said pump chamber;

a pressure valve disposed in said valve housing downstream of said pump chamber for passing the fuel pumped by said injection pump;

an injection line connected to said pressure valve for conducting the pumped fuel to the engine;

said base housing having a space formed therein and said injection pump further including: a membrane mounted in said base housing and delimiting a work chamber in said space; and, means for connecting said membrane to said piston;

conduit means for connecting the crankcase of said engine to said work chamber for charging said work chamber with said crankcase pressure thereby driving said membrane and said piston;

interface sealing means for providing a seal-tight interface between said base housing and said valve housing;

receptacle means formed on said valve housing for providing a seal-tight connection with said injection line;

a fuel pump having a pressure connection and said suction line being connected to said pressure connection;

said fuel pump being configured as a component part attached to said base housing;

a fuel return connected to said fuel tank;

a pressure-holding valve mounted in said valve housing; and, said suction line being connected to said fuel return via said pressure-holding valve.

* * * * *